US006325727B1

(12) United States Patent
Carr

(10) Patent No.: US 6,325,727 B1
(45) Date of Patent: Dec. 4, 2001

(54) AQUATIC GOLF SWING TRAINING DEVICE AND METHOD FOR ENHANCING GOLF SWING MEMORY AND STRENGTH

(76) Inventor: John Carr, 1010 Republic, Addison, IL (US) 60101

( * ) Notice: Subject to any disclaimer, the term of this patent is extended or adjusted under 35 U.S.C. 154(b) by 0 days.

(21) Appl. No.: 09/440,780

(22) Filed: Nov. 16, 1999

(51) Int. Cl.[7] ..... A63B 69/36
(52) U.S. Cl. ..... 473/228; 482/111; 440/101
(58) Field of Search ..... 440/21, 101, 102; D15/215; 482/906, 109, 111; 473/228

(56) References Cited

U.S. PATENT DOCUMENTS

D. 20,161 * 9/1890 Raibert ..... D12/215
D. 364,598 * 11/1995 Eversole ..... D12/215
3,606,340 * 9/1971 Tiller ..... 473/228
4,622,017 * 11/1986 McGraw ..... 440/101
5,613,915 * 3/1997 Van Alen, Jr. ..... 473/228
5,851,132 * 12/1998 Merrill ..... 440/101
5,902,162 * 5/1999 Kot et al. ..... 440/101

* cited by examiner

*Primary Examiner*—Mark S. Graham
*Assistant Examiner*—Raeann Gorden
(74) *Attorney, Agent, or Firm*—Leydig, Voit & Mayer, Ltd.

(57) ABSTRACT

A golf swing training device and a method of its use in an aquatic environment. The device includes a manually grippable handle secured to a shaft that has integrally secured thereto adjacent the handle a hydrodynamically adjustable paddle that may be manually physically altered to provide a variable resistance to a user that grips the handle and wings the golf swing training device through water that compresses the aquatic environment.

2 Claims, 4 Drawing Sheets

FIG. 5
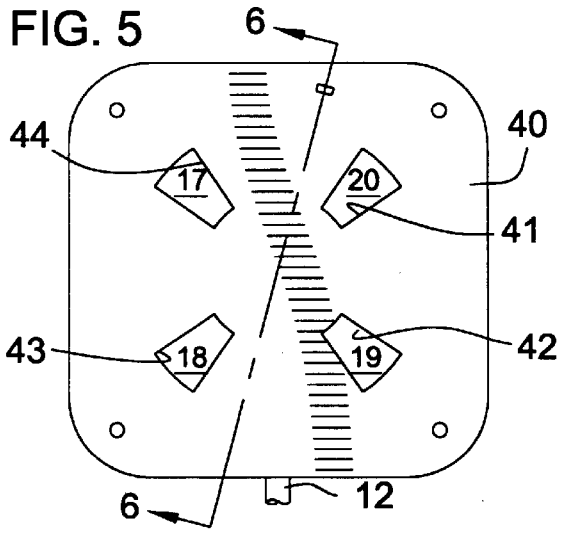
FIG. 6
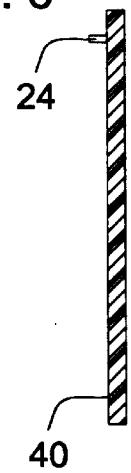
FIG. 7
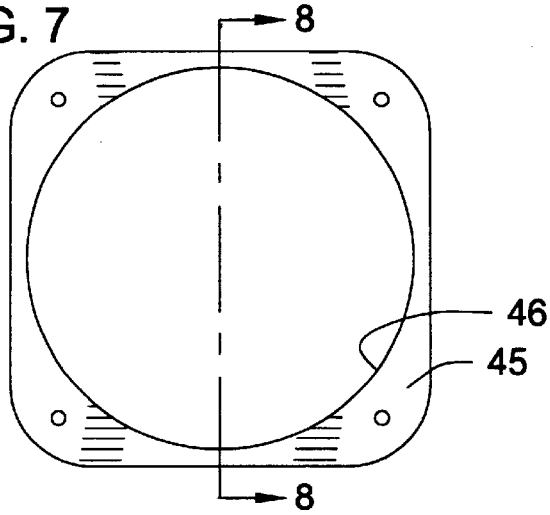
FIG. 8
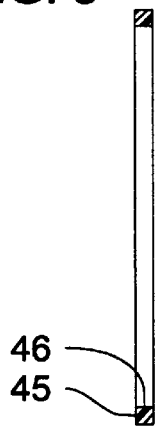
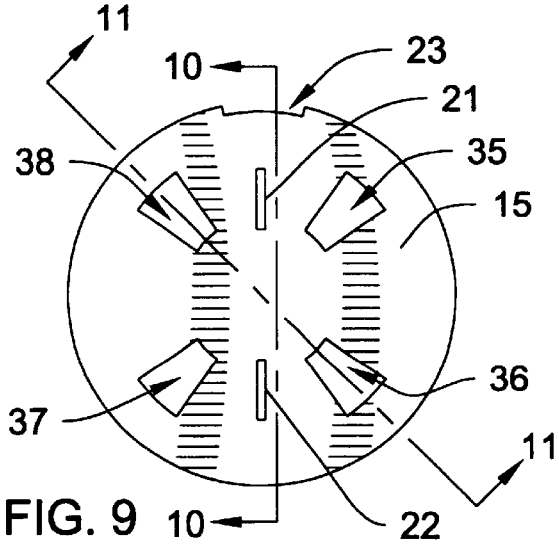
FIG. 9
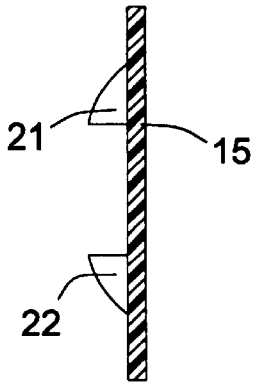
FIG. 10
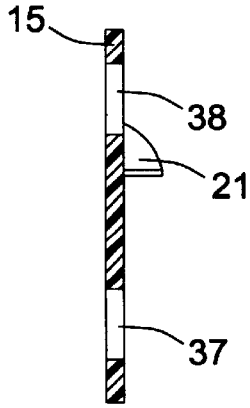
FIG. 11

FIG. 12
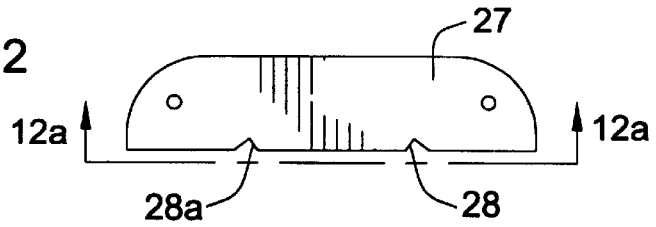
FIG. 12a
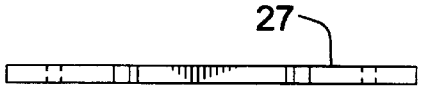
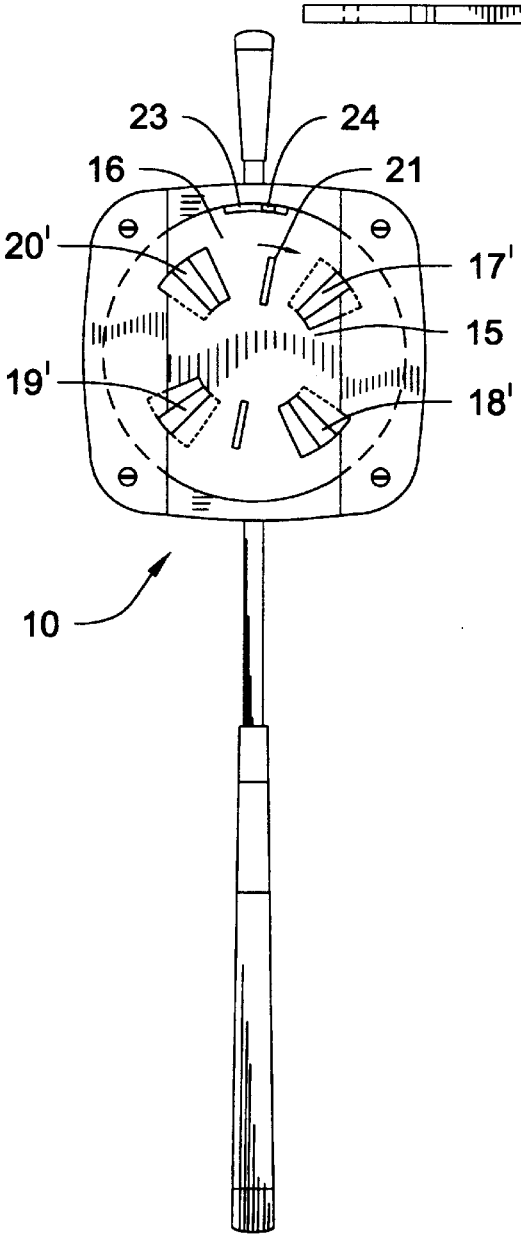
FIG. 13
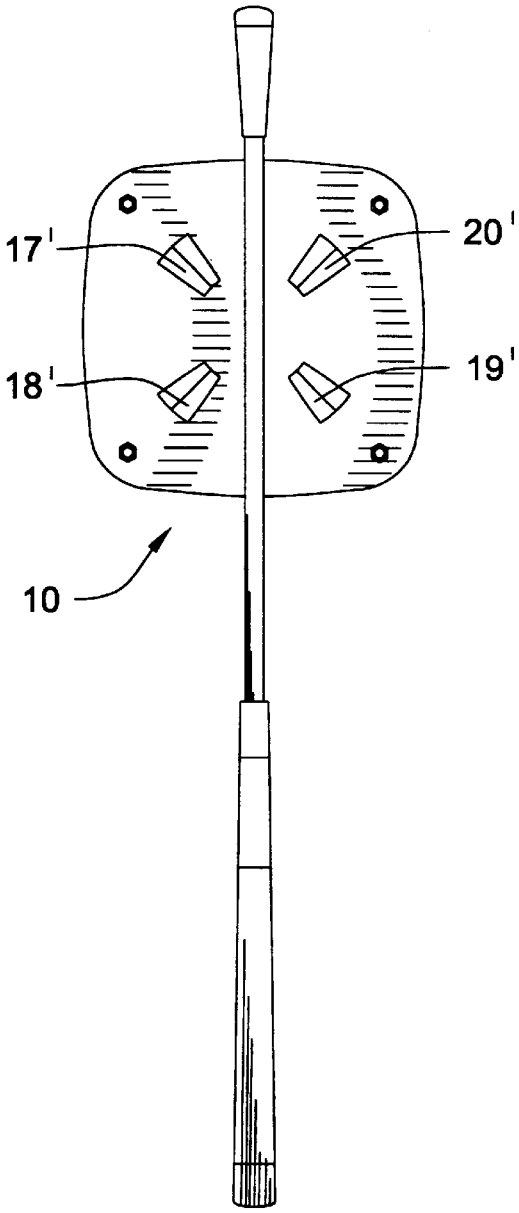
FIG. 14

AQUATIC GOLF SWING TRAINING DEVICE AND METHOD FOR ENHANCING GOLF SWING MEMORY AND STRENGTH

FIELD OF THE INVENTION

This invention relates to a golf swing training device and more particularly to a golf swing training device and method for use of the device in an aquatic environment where the use of the device and method enhances muscle memory and golf swing strength.

BACKGROUND OF THE INVENTION

Golf is a simple sport that involves the use of a golf club which has at one end thereof a weighted club head connected by a shaft to a handle gripped by the golfer. The object of the sport is to swing the golf club in a manner that causes the club head to pass through an arc and strike a golf ball adjacent the ground so that the impact of the head with ball causes the ball to move towards a preselected destination, namely, a hole in the ground. The sport of golf is easy to describe but difficult to execute as many factors are involved in the accurate swinging of the club to strike the ball in a controlled manner.

The neurobiology involved in a golf swing is equally simple to describe. The cerebellum in the base of the human brain is connected via the spinal cord to all the muscles in the body. The cerebellum is responsible for the coordination of muscle movement and therefore controls gross and fine motor movements of muscles in the body.

Brain cells, that is neurons are comprised of a cell body and an axon i.e., nerve fiber that emanates from the cell. The neuron when activated will produce an electrical signal that travels along the nerve fiber to another neuron(s) which in turn are triggered to produce a signal that eventually reaches a fibrous bundle of muscles in the body. The delivery to the muscle of the electrical signal via the nerve fiber causes the muscle to contract. Muscles connected at either end to joints or other muscles respond by moving an associated limb or muscle in response to the contraction of the muscle. The just described controlled activation of a muscles is only half of the story. There are neurons located in the muscles of the body that are connected to the brain via nerve fibers. Any physical stimulation of the muscles causes these neurons in the muscles to generate signals representative of physical stimulation and these signals are fed back to the brain to complete a servo loop with neural circuits in the brain that are involved in generating muscle control signals. These muscle controlled neural circuits are also connected to portions of the brain that respond to visual input from the eyes. The human mind which is resident in the brain directs the cooperation of the muscle control neural circuits in the cerebellum with visual input. Feedback from the muscles actually aides in the formation of the muscle control neural circuits in the brain. The stronger the feedback signal to the muscle control circuits the more completely these circuits develop. It is these muscle control circuits that are involved in that which is called muscle memory. It is believed by many that the more this just described muscle control circuit servo loop is activated the stronger it becomes. For example, once an individual learns to ride a bicycle the ability to ride a bike is recorded in muscle memory circuits and continues to be operative for a life time.

It should also be recognized that the development of muscle memory of a golf swing is essential to effortless swings that allow the club head to accurately hit the golf ball. This, however, is only half of the story because the distance the ball will travel is dependent upon the momentum of the club head when it strikes the ball. Momentum is measured as a function of the mass of club head and the velocity it reaches at the moment of impact with the ball. The velocity of the club head is, in part, a function of the muscular energy delivered to club from the muscles of the back shoulders and arms of the golfer. Where distance the golf ball travels is a desirable outcome then the condition of these muscles is also vital to delivering the golf ball to a desired location. It is common knowledge that repetitive flexing of a muscle against a resistive force strengthens the muscle. It follows that when specifics sets of muscles repetitively experience resistance to flexing they physically change to accommodate the increased resistance. We characterize this physical change as increased strength which means these muscles have a greater capacity to deliver muscle energy to the golf club handle.

It would seem that the most successful golfer would have great muscle memory and muscle strength tailored to the specific muscles involved in the muscle memory.

In view of the foregoing, muscle memory involves the neural circuitry of the brain as well as the neural circuits that find their origin in the muscles of the body and connect to neural circuits in the brain. It is the servo loop circuit comprised of both brain and body neural circuits that establishes what this application defines as a muscle memory circuit or muscle memory as it will be called hereinafter.

It is against this just described explanation of muscle memory and golf swing training that the prior attempts to enhance muscle memory and improve golf swing will be distinguished.

The pursuit of golfing excellence has led a long line of inventors to develop training devices that enhance a golfers muscle memory and strength. Golf swing training in an aquatic environment is shown and described in the aquatic exercise assembly of D. Solloway, U.S. Pat. No. 4,311,306, issued Jan. 19, 1982. Solloway equips the head of a golf club with a water resistance exercise assembly that enhances the resistance of the golf head assembly as it passes through the water. Variation in resistance experienced by the user is accomplished by varying the speed at which the user swings the golf club training device through the water. Use of the Solloway device reportedly will improve muscle memory and muscle strength. An overriding concern not addressed by the Solloway patent asks what specific muscles are involved in the muscle memory developed by swinging the club through the water. In the Solloway training device the water resisting exercise assembly is located in the region of the golf club head. It takes very little imagination to visualize the exercise assembly at the head of the golf club being swung through the water. The resistive force experienced by the golf head assembly will be transmitted as a torque delivered to the wrist and lower arm of the user. The lever arm involved in generating the torque is of course defined by the length of golf club shaft where the users hand grasp a handle. When the neurobiology of muscle memory is taken into account it is immediately recognized that the reactive forces experienced by the muscles in the users wrists and lower arms generate feedback signals to the brain that aid in the formation of muscle control servo loop circuit that establishes muscle memory. This memory circuit will not match the nature of a muscle memory circuit needed by the user when the user leaves the aquatic environment. It also follows that the muscles that are strengthened are not the ones employed when the golfer swings a club in a non-aquatic environment.

The need to strengthen specific muscles involved in a golf swing as well as ensuring that the golfer keep an eye on the ball during a swing is addressed by the golf swing training and exercising devise of A. Kiehl in U.S. Pat. No. 4,326,718 issued Apr. 27, 1982. The Kiehl device wisely recognizes that the position of a golfers head and eyes is a factor in perfecting a golf swing and provides a physical head restraint to correctly position the golfers head during a swing of the golf club. The Kiehl training device is equipped with variable resistance load that operates through a series of swing arms that cooperate with a hand grip that the user engages and attempts to move through an arc of the nature needed to swing a golf club. Here while the path of the club swing may be practiced the resistive load feedback via the swing arms does not duplicate that experienced by the muscles of the golfer when the golfer is on a golf course executing his swing during normal play.

A concern for the actual swing of a golf club and the golfer's body position during the execution of practice swings is addressed by the golf swing guide of R. L. Meeker in U.S. Pat. No. 4,815,743 issued Mar. 28, 1989. Meeker's swing guide is fashioned of a large planar member equipped with curved collar that engages the users neck during a practice swing. The planar member acts to constrain the possible path of club during a swing of a golf club. The Meeker device provides no resistive loading to the muscles involved in the golf swing other than the normal loading to a golf club handle brought on by the centrifugal force generated by movement of the golf head during a swing. Here we see missing a vital compound of muscle memory circuit development, namely a strong feedback signal from the muscles involved in swinging the golf club. It may be argued that if you practice a controlled golf swing long enough you will eventually develop a strong muscle memory circuit of the swing. Use of the Meeker device will not quickly develop such muscle memory circuit and furthermore use of the Meeker device would do little to strengthen the muscles involved in a golf swing.

A concern for strengthening specific muscles involved in any sport is recognized in the resistance training device of P. G. Norman, U.S. Pat. No. 5,151,070 issued Sep. 29, 1992. The Norman training device includes a handle that may be grasped and moved only in one of a series of constrained paths that are intended to emulate a physical motion involved in a particular sport such as golf. When the user grasps a handle of the exercise device and moves it in the constrained path a constant resistive loading is experienced by the user even as the user returns to a start position. It would appear that the Norman device would aid in strengthening muscles needed to move the hands, arms and shoulder muscles through a preselected physical path. In the matter of muscle memory, the muscle memory circuit developed is a circuit that develops with a continuous feedback signal representative of the load. Use of Norman device may well strengthen specific muscles but at the expense of muscle memory circuits that need to be tailored for use in normal golfing.

In both U.S. Pat. No. 5,470,071 of Hsu, et al. issued Nov. 28, 1995 and U.S. Pat. No. 5,620,376 to Hsu issued Apr. 15, 1999 the golf training devices disclosed employ the use of liquid containing devices near the head of the golf club which deliver a fine stream of water from the club head region when the club is swung. The stream of water creates a trail of water spots on the ground to reveal the path the golf club experienced. These inventions no doubt are useful in attempts to correct a swing but fall short of developing muscle memory and muscle strength.

More recently an underwater exercise device in the form of a shaft having a dish shaped element secured to the end of the shaft to emulate a golf club is shown and described in the Lockbaum, U.S. Pat. No. 5,813,952 issued Sep. 29, 1998. The device is shown in the hands of a user completely emersed in water. The user is provided with an air supply hose to breath through while he waves the shaft and dish shaped element around in the water to get exercise.

All of the foregoing patents in some respect recognize either a need to practice a golf swing to perfect the same or to strengthen muscles involved in a golf swing. The invention to be described hereinafter is directed to a device that enhances specific muscle memory circuit development in a golfers body while simultaneously strengthening specific muscles involved in a golf swing.

SUMMARY OF THE INVENTION

The present invention is directed to a golf swing training device and a method of its use in an aquatic environment. The device includes a manually grippable handle secured to a shaft that has integrally secured thereto adjacent the handle a hydrodynamically adjustable paddle that may be manually physically altered to provide a variable resistance to a user that grips the handle and swings the golf swing training device through water that compresses the aquatic environment.

The primary object of the invention is to provide a golf swing training device and a method of its use that enhances muscle memory of a golf swing.

Another object of the invention of comparable importance is to provide a golf swing training device that improves the strength of specific muscles involved in a golf swing.

Yet another object of the invention is the provision of a method of physical exercise that employs an aquatic exercise device that provides variable physical resistance as it moves through water to thereby enhance muscle memory development and muscle strength.

In the attainment of the foregoing objects the invention contemplates as falling within the preview of the attached claims a golf swing training device for use in an aquatic environment where the user desires to practice a golf swing where substantial resistance to the swing is experienced by the user as the device is manually swung through the water thereby encouraging the development of muscle memory of the swing while strengthening the muscles involved in the swing of the device. The training device includes a manually grippable handle concentrically secured to a shaft that has integrally secured thereto adjacent the handle a hydrodynamically adjustable paddle. The paddle has a generally dish shaped configuration and includes a variable resistance mechanism that may be manually manipulated to vary the paddle area of the device and therefore the resistance the user experiences as the device is swung through the water. The variable resistance mechanism includes at least one opening through the paddle, the size of which opening may be manually adjusted to change the paddle area. The variable resistance mechanism also includes a dish shaped element with an aperture therethrough that cooperates with a manually moveable shutter to vary the size of the aperture opening and thereby vary the area of the paddle that engages the water as the device is swung throughout the water.

Other object and advantages of the invention will become more apparent from the following detailed description when taken in conjunction with the accompanying drawings.

BRIEF DESCRIPTION OF THE DRAWINGS

FIG. 5 depicts a full view of a paddle shaped apertured component shown in section in FIG. 4.

FIG. 6 is a section taken along line 6—6 in FIG. 5.

FIG. 7 depicts a full view of spacer shown in section in FIG. 4.

FIG. 8 is a section view taken along line 8—8 in FIG. 7.

FIG. 9 is an illustration of a manually moveable apertured shutter involved in the practice of the invention.

FIG. 10 is a section view taken along line 10—10 in FIG. 9.

FIG. 11 is a section view taken along line 11—11 in FIG. 9.

FIG. 12 is a plan view of a retaining strap.

FIG. 12*a* is a view taken along line 12*a*–12*a* in FIG. 12.

FIG. 13 is an illustration of the golf swing training device that embodies the invention here showing adjusted aperture openings.

FIG. 14 is a rear view of FIG. 12.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 1:
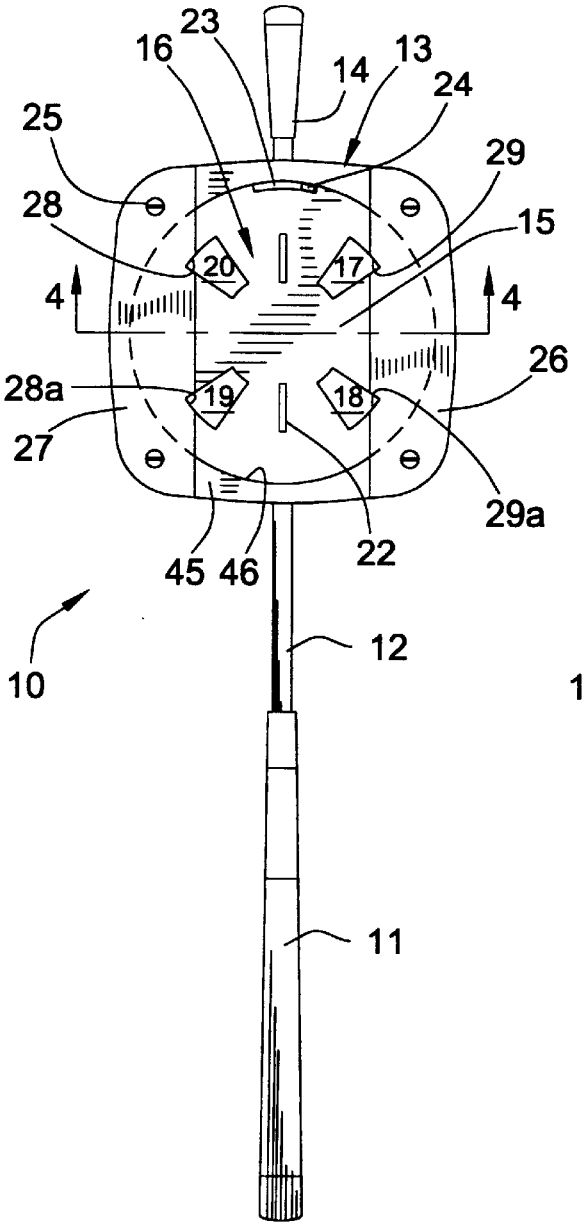
FIG. 1 is a front view of a golf swing training device that embodies the invention.
Figure 2:
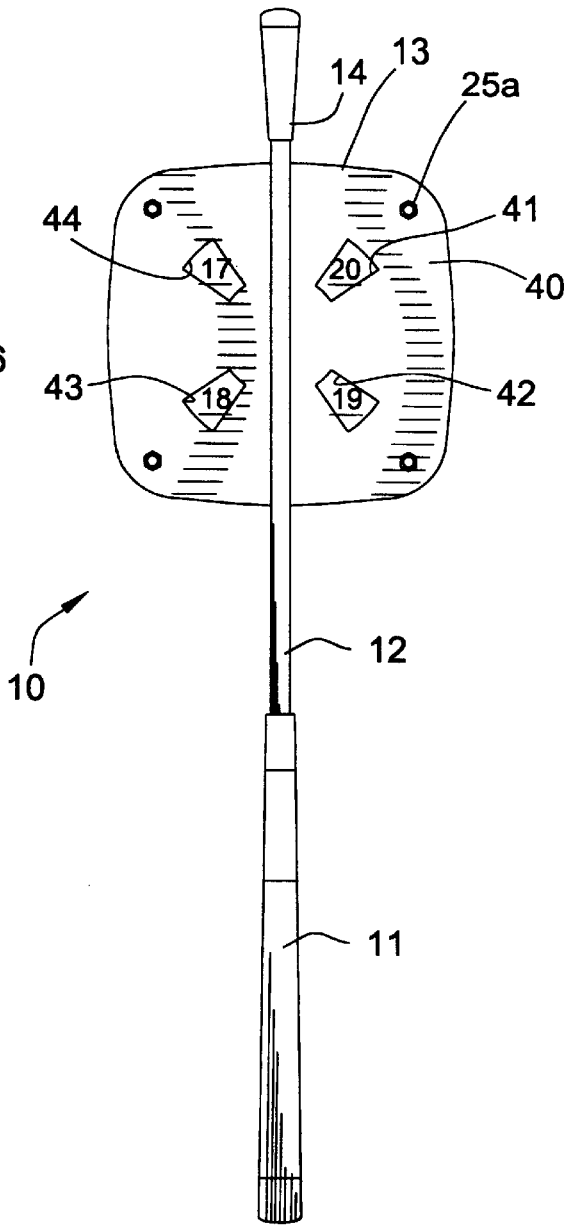
FIG. 2 is a rear view of FIG. 1.
Figure 3:
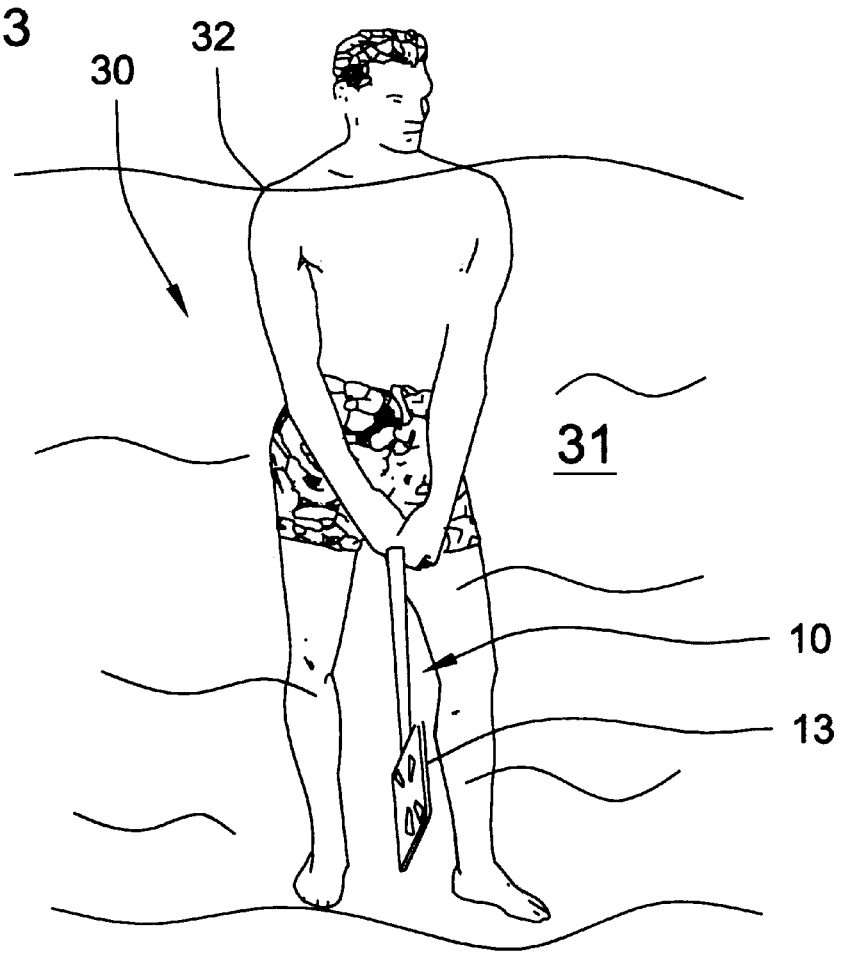
FIG. 3 is a perspective illustration of a schematic representation of a human using the golf swing training device in an aquatic environment.

Reference is now made to FIGS. 1, 2 and 3 which when studied together along the explanation that follows will provide a basic understanding of the nature of the invention. A golf swing training device 10 is provided with a manually grippable handle 11 that is concentrically secured to a shaft 12. The handle 11 and shaft 12 may be made of the same materials golf club handles and clubs are normally made of. A hydrodynamically adjustable paddle 13 is secured to the shaft 12 by any suitable means. The various components of the paddle are preferably made of plastic. The location of the paddle 13 adjacent the handle 11 is important. In this location the resistive cooperation of the paddle 13 with water 31, FIG. 3 as the device is swung through the water results in a set of reactive forces in the arms and shoulders of the user rather than the wrist and lower arm that would arise if the paddle 13 was located remote from the handle 11. In the preferred embodiment the paddle 13 has a generally dish shaped configuration and is secured to the shaft 12 such that the dish shaped configuration is symmetrically disposed on both sides of the shaft 12 as is most easily seen in FIG. 2. The shaft 12 terminates with a protective grip element 14. Before the detailed construction of the golf swing device 10 is undertaken a moments focus on FIG. 3 will reveal a user 30 of the golf swing device 10 with its hydrodynamically adjustable paddle 13 submerged to shoulder level 32 in water 31 that comprises the aquatic environment. The dish shaped hydrodynamically adjustable paddle 13 includes a variable resistance mechanism 16 that may be manually manipulated to vary the paddle area that engages the water and therefore the resistance a user experiences in their wrist, arms and shoulder as the device 10 is swung through the water.

It should be readily apparent as FIGS. 1 and 2 are studied that there are four apertures or openings 17, 18, 19, 20 that extend completely through the paddle 13. The size of these opening 17, 18, 19 and 20 may be varied from a full open condition as shown to a fully closed condition or any intermediate condition between open and closed as will be explained when FIGS. 13 and 14 are described hereinafter.

The dish shaped paddle 13 includes a shutter 15 with openings the outer perimeters of which coincide with the perimeters 41, 42, 43, 44 of the apertures openings 17, 18, 19, 20, see FIG. 2.

In a manner that will be described next the dish shaped paddle 13 with its plurality of openings and the shutter with its array of matching openings are positioned in relation to each other such that manual movement of the shutter 15 by means of a user engaging upstanding finger tabs 21, 22 with their fingers and twisting creates a torque that causes the array of openings in the shutter 15 to move relative to the openings in the dish shaped paddle 13 to thereby vary the overlapping openings of the shutter 15 ad therefore the area of the dish shaped paddle 13.

Figure 4:
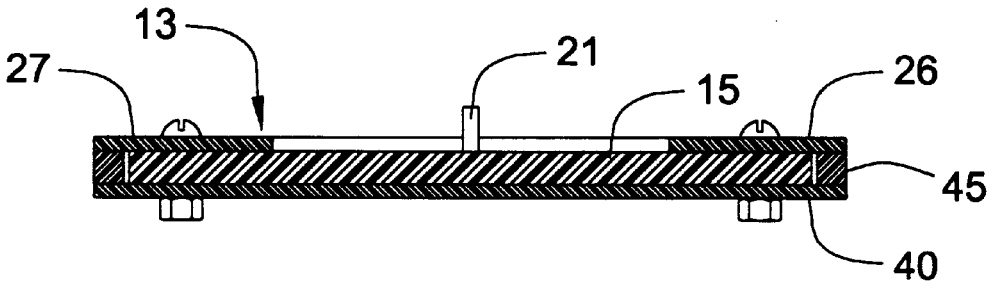
FIG. 4 is a section taken along line 4—4 in FIG. 1.

The specific details of the construction of the golf swing device 10 will be fully comprehended when FIGS. 1 and 4 are first examined and explained and then each structural component of the golf swing device which are shown in FIGS. 5 through 12*a* are described in a similar manner.

Attention is now directed to FIG. 4 which is a cross-section taken along line 4—4 in FIG. 1. Here the paddle 13 is shown to include four structural elements, namely the dish shaped element 40 upon which the shutter 15 is shown nested in spacer 45. A pair of retaining straps 25, 26 are connected to the dish shaped element 40 by means of four fasteners, one of which 25 is referenced. Fastener 25 cooperates with a nut 25*a* on the backside of the dish shaped element 40 as is indicated and shown in FIG. 2.

Now that the general nature of the manner in which the various components of the golf swing device 10 are assembled is accomplished a review of the construction details of each component will now be under taken. When the dish shaped element 40 illustrated in FIGS. 5 and 6 are examined it will be noticed that there exists on a face of element 40 a stop pin 24 disposed near an upper edge of the element 40. This stop pin 24 cooperates with an arcuate notch 23 of shutter 15, see FIGS. 1 and 9.

Immediately above the dish shaped element 40, as seen in FIG. 4, a spacer 45 having a circular opening 46, FIGS. 7 and 8, is positioned to cooperate with the shutter 15 which is nested in the circular opening 46.

In FIGS. 9, 10 and 11 details of the shutter 15 are made evident. As noted earlier the shutter 15 is provided with a plurality of apertures or openings here referenced by numerals 35, 36, 37, 38. Upstanding finger tabs 21, 22 and arcuate notch 23 complete the specific features of the shutter 15.

FIGS. 12, 12*a* depict one of the retaining straps 27 and clearly reveals a pair of notches 28, 28*a* that can be seen in FIG. 1 cooperating with the perimeter of openings 19 and 20. Retaining strap 26 is comparable equipped with notches 29, 29*a* and provides a function similar to that which has just been described with respect to strap 27.

The last set of illustrations are FIGS. 13 and 14 show the golf swing training device 10 with the shutter 15 rotated to reduce the size of the openings created by movement of the shutter 15 and its openings relative to the openings in the paddle 14. These openings have been given reference numerals 17' 18', 19' and 20'. Because these openings 17', 18', 19' and 20' are smaller the effective area of the dish shape padded 13 is greater than as is shown in FIG. 1. Accordingly as the training device, so adjusted is moved through the water the resistance to movement through the water will increase.

In the foregoing description of the highly preferred embodiment of the invention the shutter 15 is depicted as a rotary device. The invention is intended to encompass shutter arrangements where the shutter simply slides in a reciprocating fashion back and forth past a set of corresponding openings in a dish shaped element. A most significant facet of the invention resides in the ability of the user of the training device to adjust the resistance experienced during training.

The detailed description of the structural nature of the golf swing training device just enumerated is believed to be sufficient for anyone to make a comparable device that embodies the invention.

In addition to the apparatus aspects of the invention the invention also involves a method of using the golf swing training device that incorporates the invention in a manner that enhances the rate of muscle memory creation and specific muscle memory related to a golf swing along with muscle strength.

Professional golfers are the envy of many a duffer who as an amateur only gets to play on weekends. It is little consolation to the amateur to be advised that they can develop a swing just like the pro's by simply going to a golf driving range and hitting a thousand balls every week like the pros do. The pros develop muscle memory and muscle strength by these ritualistic regimen of driving golf balls. It is often wondered if there is a better way to accomplish the same end, and there is, once a basic appreciation of the neurophysiology of a golf swing is understood.

Peak performance in any sport requiring physical dexterity and coordination is achieved in what many describe as a four step, four level process. The first level is designated as a level of conscious incompetence. The second level is known as the level of conscious competence; the third level as the level of unconscious competence and the fourth level is the highly sought after level of unconscious mastery.

Anyone who has learned to drive a stick shift car can remember experiencing conscious incompetence. Mentally coordinating in a simultaneous fashion multiple simple tasks can be distressing. Knowing consciously the steps involved in integrating experientially gear shift position, clutch release, gas peddle position and steering all at the same time seems to many a daunting task.

The level of conscious competence is experienced as the individuals mentally talk to themselves and provide continuous mental instruction to deliver electrical command impulse to muscles involved in getting the car underway. As this conscious level of competence develops, feedback from the neurons via nerve fibers from various muscles in the body is causing a muscle control servo loop circuit to strengthen. The beginning of unconscious competence evolves as mental-self instruction diminishes. Unconscious mastery begins to evidence itself when input from the environment that arises as an individual engages the environment with their senses automatically in a free-flowing manner triggers the firing of muscle control memory circuits of the brain/body system.

The genius of the golf swing training device embodying the invention and its use in an aquatic environment resides in the method of using the variable resistance nature of the golf swing training device in a simple regime now to be described.

Those familiar with the fundamentals of a golf swing will recall that the golfer addresses the golf ball with the face of the golf club head and then slowly moves arms and wrists uniformly through an arc until the hands that grip the club handle are about shoulder height when the wrists begin to hinge on the back swing and release on the through swing. There exists in the market place fan like devices that may be secured to a golf club that increase its resistance to movement during a golf swing and thereby enhance feedback signals to a muscle memory circuit in development. The magnitude of the muscle feedback signals are dependent on the resistance the muscles of the arms, wrists and the shoulders experience as the golf club is swung.

The arcuate path the golf club transverses and the muscle memory servo circuit that controls the path of golf club path initially involve a relatively slow consciously controlled swing. This slow swing produces a low level of feedback signals to the muscle memory servo circuit under development. There are devices in the market place that physically cooperate with golfer or the golfer and their club to guide the club head in an ideal path to strike the ball in an optimal fashion. There appears to be little question that these just described approaches help the golfer over the long haul develop muscle memory. Muscle strength, however, appears to be developed in the specific muscles involved in the swing only when the muscles involved experience a resistance to contraction while in use. Devices that attach to a golf club head or to the shaft of golf club when moved through air or a water medium will increase the resistance experienced by the muscles involved in the swing. When users of these arrangements want to increase muscle strength they must increase the resistance forces being experienced during the golf club swing. This can only be accomplished by increasing the speed of the swing. It is not uncommon for the accuracy of golf clubs to diminish as the speed increases.

The ultimate method of golf swing training to produce precise muscle memory and simultaneously strengthening specific muscles involved in the swing involves the use of the subject golf swing training device that embodies the invention. The method is comprised of the following steps:

(a) immersing an individual to be trained in an aquatic environment such that the water is about shoulder level of the individual;

(b) having the individual grip a variable resistance device as one would grip a golf club, the device being adjustable to vary resistance to movement of the device through the water when the device is swung at a relatively constant velocity from near shoulder level in the water in an arc that emulates a golf swing; and (c) manually increasing the devices resistance to movement through the water during repetitive swings to thereby gradually increase specific muscle strength in body muscles involved in the swing while simultaneously increasing muscle memory.

In the method described above the individual may move quickly from conscious incompetence to conscious competence almost immediately because the individual practicing the method gets a very strong feedback signal from a slow movement of the variable resistance device through the water. The individual may then increase the resistance the wrist arms and shoulders are experiencing as the individual consciously executes a controlled perfect arcuate movement through the water. Because the neural circuits involved in the servo loop are a system a classic system benefit arises in the nature of a positive feedback loop that exponentially improves muscle memory and muscle strength. Once there has been developed a strong muscle memory and muscle strength the golfer will still need to keep their eye on the ball to bring into play another servo loop that involves the visual cortex of the brain to provide fine motor control to guide the muscle memory in the execution of a golf swing when the golfer is on the golf course.

Developing unconscious mastery is the last stage of training and has a great deal to do with the mental state of the golfer which may well benefit from a golfer having used the golf training device and method described hereinbefore to consistently and powerfully drive a golf ball down a fairway.

What is claimed is:

1. A training method for golf swing and muscle memory development in an aquatic environment where an individuals golf swing and associated muscle memory of the swing are simultaneously established, the method comprised of the following steps:

(a) immersing an individual to be trained in an aquatic environment such that the water is about shoulder level of the individual;

(b) having the individual grip the device as one would grip a golf club, the device being adjustable to vary the resistance to movement of the device through the water when the device is swung at a relatively constant velocity from near shoulder level in the water in an arc that emulates a golf swing, and (c) manually increasing the devices resistance to movement throughout the water during repetitive swings to thereby gradually increase muscle strength in body muscles involved in the swing while simultaneously increasing muscle memory.

2. A golf swing training device for use in an aquatic environment where the user desires to practice a golf swing while substantial resistance to the swing is experienced by the user as the device is manually swung through the water thereby encouraging the development of muscle memory of the swing with strengthening the muscle involved in the swing of the device, the golf swing training device including:

a manually grippable handle secured to a shaft that has integrally secured thereto adjacent the handle a hydrodynamically adjustable paddle that may be manually physically altered to provide a variable resistance to the user that grips the handle and swings the golf swing training device through the water, said hydrodynamically adjustable paddle having a generally dish shaped configuration and a variable resistance mechanism that may be manually manipulated to vary the paddle area of the device and therefore the resistance the user experiences as the device is swung through the water, said mechanism including a dish shaped and planar element having an array of openings the size of which can be manually adjusted to change the paddle area, a manually rotatable planar shutter overlying the dish shaped element having a corresponding array of openings such that manual rotary movement of the shutter with the array of openings allows the array of shutter openings to move across the openings in the dish shaped element to vary the size of the combined openings of the shutter and the dish shaped element, and the plurality of openings in the dish shaped element are radially disposed along a common loci of points and the array of openings in the shutter are radially disposed along a loci of points that matches the loci of points of the openings in the dish shaped element such that rotation of the shutter brings the array of openings into cooperation with the radially disposed openings of the dish shaped element to thereby control the combined size of the openings through the dish shaped element created by the relative movement of the shutter openings with the dish shaped element openings.

* * * * *